US008146584B2

(12) United States Patent
Thompson

(10) Patent No.: US 8,146,584 B2
(45) Date of Patent: Apr. 3, 2012

(54) PRESSURE SWITCH ASSEMBLY FOR A FURNACE

(75) Inventor: Kevin D. Thompson, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 1523 days.

(21) Appl. No.: 11/607,711

(22) Filed: Dec. 1, 2006

(65) Prior Publication Data

US 2008/0127962 A1 Jun. 5, 2008

(51) Int. Cl.
*F23N 1/02* (2006.01)

(52) U.S. Cl. ..... 126/116 A; 431/18; 431/19; 236/1 A; 236/1 E; 236/15 C

(58) Field of Classification Search ..... 431/12, 431/18, 19, 62, 63, 75, 89, 90; 236/1 A, 236/1 E, 1 EA, 1 EB, 15 C
See application file for complete search history.

(56) References Cited

U.S. PATENT DOCUMENTS 2,292,830 A * 8/1942 Gauger et al. ..... 236/1 R
2,924,387 A * 2/1960 Hajny ..... 236/1 E
3,367,408 A * 2/1968 Moreland ..... 165/269
4,390,125 A * 6/1983 Rozzi ..... 237/70
4,513,910 A * 4/1985 Bartels ..... 236/26 R
4,648,551 A * 3/1987 Thompson et al. ..... 236/49.3
4,688,547 A * 8/1987 Ballard et al. ..... 126/116 A
4,703,747 A * 11/1987 Thompson et al. ..... 126/112
4,706,881 A * 11/1987 Ballard ..... 236/15 BD
4,729,207 A 3/1988 Dempsey et al.
4,756,475 A * 7/1988 Vergne ..... 237/56
4,787,554 A * 11/1988 Bartels et al. ..... 236/26 R
4,789,330 A * 12/1988 Ballard et al. ..... 431/75
5,022,460 A * 6/1991 Brown ..... 165/262
5,307,990 A * 5/1994 Adams et al. ..... 236/11
5,347,981 A * 9/1994 Southern et al. ..... 126/116 A
5,379,752 A 1/1995 Virgil, Jr. et al.
5,522,541 A * 6/1996 Zia et al. ..... 236/10
5,590,642 A * 1/1997 Borgeson et al. ..... 126/116 A
5,601,071 A * 2/1997 Carr et al. ..... 126/116 A
5,676,069 A * 10/1997 Hollenbeck ..... 110/147
5,682,826 A * 11/1997 Hollenbeck ..... 110/147
5,732,691 A * 3/1998 Maiello et al. ..... 126/116 A
5,865,611 A * 2/1999 Maiello ..... 431/12
5,938,425 A * 8/1999 Damrath et al. ..... 431/62
6,161,535 A * 12/2000 Dempsey et al. ..... 126/110 R
6,283,115 B1 * 9/2001 Dempsey et al. ..... 126/110 R
6,321,744 B1 11/2001 Dempsey et al.
6,370,894 B1 4/2002 Thompson et al.
6,571,817 B1 * 6/2003 Bohan, Jr. ..... 137/88
6,609,904 B2 * 8/2003 Chen ..... 431/71
6,758,208 B2 * 7/2004 Gierula et al. ..... 126/116 A
6,851,948 B2 2/2005 Dempsey et al.
6,925,999 B2 * 8/2005 Hugghins et al. ..... 126/116 A
6,971,871 B2 * 12/2005 Ahmady ..... 431/180
7,101,172 B2 * 9/2006 Jaeschke ..... 431/19
(Continued)

*Primary Examiner* — Carl Price
(74) *Attorney, Agent, or Firm* — Cantor Colburn LLP

(57) ABSTRACT

A pressure switch assembly is used with a furnace controller having a first input and a second input. A first pressure switch is configured to actuate at a first combustion pressure level and is connected to the first input. A second pressure switch is configured to actuate at a second combustion pressure level, and a third pressure switch is configured to actuate at a third combustion pressure level. Pressure signals provided on the second input from at least one of the second pressure switch and the third pressure switch are used by the furnace controller to derive actuation states of the second and third pressure switches.

6 Claims, 4 Drawing Sheets

U.S. PATENT DOCUMENTS

| | | | | |
|---|---|---|---|---|
| 7,455,238 | B2 * | 11/2008 | Hugghins | 236/15 R |
| 7,513,247 | B2 * | 4/2009 | Clauss et al. | 126/39 E |
| 7,523,762 | B2 * | 4/2009 | Buezis et al. | 137/613 |
| 2006/0105279 | A1 * | 5/2006 | Munsterhuis et al. | 431/18 |
| 2008/0124667 | A1 * | 5/2008 | Schultz | 431/18 |
| 2008/0127962 | A1 * | 6/2008 | Thompson | 126/116 A |
| 2008/0127963 | A1 * | 6/2008 | Thompson | 126/116 A |
| 2011/0100349 | A1 * | 5/2011 | Hugghins | 126/116 A |

* cited by examiner

PRESSURE SWITCH ASSEMBLY FOR A FURNACE

BACKGROUND OF THE INVENTION

The present invention relates to the field of gas furnaces, and in particular to a pressure switch assembly for a multi-stage gas furnace.

With a furnace for heating a residential or commercial space, a thermostat senses when the temperature of an interior comfort space is below a set temperature. When the temperature drops below the set temperature, the thermostat provides a call for heat that turns on a gas burner and, after a delay time, a circulation air blower. The gas burner injects flame and heated gas into a heat exchanger, which heats the circulation air that is then returned to the interior space. An induced combustion fan draws combustion gases through the heat exchanger and exhausts them into a vent pipe for discharge to an outside environment. Heating continues until the thermostat senses that the interior room air has been heated above the set point, at which time it opens and ends the call for heat.

Multi-stage furnaces have gas burners that operate at different flow rates, ranging from a high flow rate (i.e., high fire) to varying levels of partial flow rates. The high fire mode is employed when there is a high demand for heating, such as when the partial flow rates fail to increase the interior room air temperature above the set point in an allotted time or when specifically commanded by the thermostat. The partial flow rates are employed when there is a lower demand for heat, and the gas burners provide a corresponding level of fire proportionate to the demand for heat.

The gas burners can be actuated into the various flow rate modes based on the states of combustion pressure switches in the furnace. Combustion pressure switches, which sense the negative pressure in the furnace combustion chamber, serve to turn the burners on only if the inducer fan is bringing enough combustion air in to support the level of fire provided by the burners. In conventional furnace systems, the furnace control is designed to have the same number of pressure switch inputs as the number of operating modes supported. Thus, a change in the number of operating modes in the furnace typically requires a change to the control circuitry of the furnace.

BRIEF SUMMARY OF THE INVENTION

The subject invention is directed to a pressure switch assembly for use with a furnace controller having a first input and a second input. A first pressure switch is configured to actuate at a first combustion pressure level and is connected to the first input. A second pressure switch is configured to actuate at a second combustion pressure level, and a third pressure switch is configured to actuate at a third combustion pressure level. Pressure signals provided on the second input from at least one of the second pressure switch and the third pressure switch are used by the furnace controller to derive actuation states of the second and third pressure switches.

DETAILED DESCRIPTION

A three-stage furnace constructed in accordance with the present invention comprises adaptations of a similar conventional two-stage furnace. Accordingly, the following description will first discuss the structure and operation of a two-stage furnace that is known in the art, and then discuss how the structure and operation of a three-stage furnace that is constructed in accordance with the present invention differs from the conventional two-stage furnace.

Figure 1:
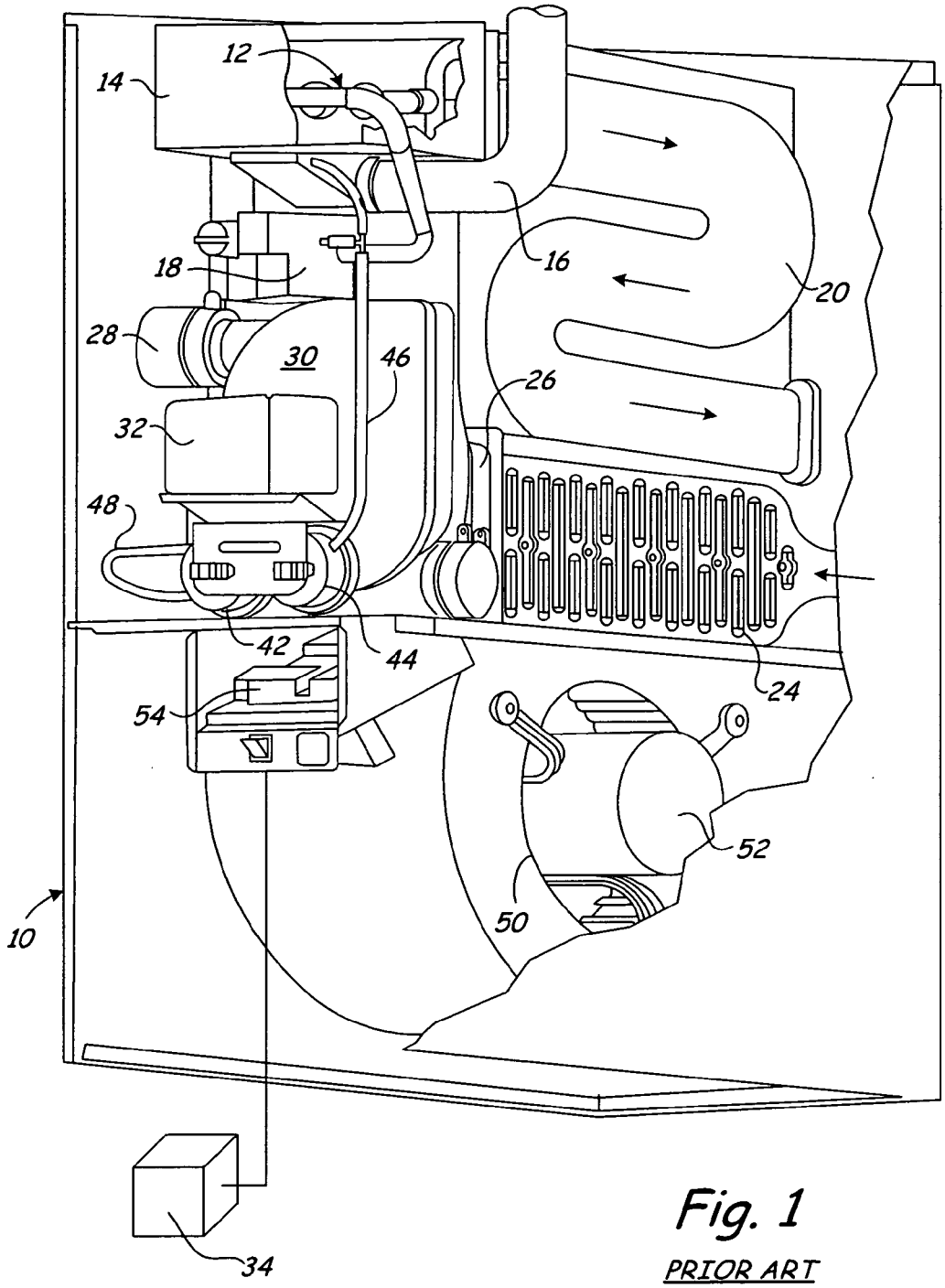
Fig. 1 PRIOR ART
FIG. 1 is a perspective, cutaway view of a conventional two-stage furnace.

FIG. 1 is a perspective cutaway view of a conventional two-stage condensing furnace 10. Furnace 10 includes burner assembly 12, burner box 14, air supply duct 16, gas valve 18, primary heat exchanger 20, condensing heat exchanger 24, condensate collector box 26, exhaust vent 28, induced draft blower 30, inducer motor 32, thermostat 34, low pressure switch 42, high pressure switch 44, pressure tubes 46 and 48, blower 50, blower motor 52, and furnace control 54.

Burner assembly 12 is located within burner box 14 and is supplied with air via air supply duct 16. The gases produced by combustion within burner box 14 flow through a heat exchanger assembly, which includes primary or non-condensing heat exchanger 20, secondary or condensing heat exchanger 24, and condensate collector box 26. The gases are then vented to the atmosphere through exhaust vent 28. The flow of these gases, herein called combustion gases, is maintained by induced draft blower 30, which is driven by inducer motor 32. Inducer motor 32 is driven in response to speed control signals that are generated by furnace control 54, in response to the states of low pressure switch 42 and high pressure switch 44, and in response to call-for-heat signals received from thermostat 34 in the space to be heated.

Fuel gas is supplied to burner assembly 12 through a gas valve 18, and is ignited by an igniter assembly (not shown). Gas valve 18 may comprise a conventional, solenoid-operated two-stage gas valve which has a closed state, a high open state associated with the operation of furnace 10 at its high firing rate, and a low open state associated with the operation of furnace 10 at its low firing rate.

Air from the space to be heated is drawn into furnace 10 by a blower 50, which is driven by blower motor 52 in response to speed control signals that are generated by furnace control 54. The discharge air from the blower 50, herein called circulating air, passes over condensing heat exchanger 24 and primary heat exchanger 20 in a counterflow relationship to the flow of combustion air, before being directed to the space to be heated through a duct system (not shown). While the present invention is described with regard to condensing furnaces (i.e., furnaces that use heat exchanger assemblies that include primary and secondary heat exchangers), it will be appreciated that the concepts of the present invention are also applicable to non-condensing furnaces (i.e., furnaces that have heat exchanger assemblies with only a single heat exchanger unit).

In two-stage furnace 10, inducer motor 32 and blower motor 52 operate at a low speed when the furnace is operating at its low firing rate (low stage operation) and at a high speed when the furnace is operating at its high firing rate (high stage operation). Motors 32 and 52 may be motors that are designed to operate at a continuously variable speed, and to operate at their low and high speeds in response to speed control signals generated by furnace control 54. Furnace control 54 may control the steady state low and high operating speeds of motors 32 and 52 and the times and the rates or torques at which they accelerate to and decelerate from these operating speeds.

The combustion efficiency of an induced-draft gas-fired furnace is optimized by maintaining the proper ratio of the gas input rate and the combustion airflow rate. Generally, the ideal ratio is offset somewhat for safety purposes by providing for slightly more combustion air (i.e., excess air) than that required for optimum combustion efficiency. In furnace 10, the excess air level is kept within acceptable limits in part by low and high pressure switches 42 and 44, respectively, which cause inducer motor 32 to run at speeds that are related to the differential pressure across the heat exchanger assembly. Low and high pressure switches 42 and 44 are connected to burner box 14 through pressure tube 46 to sense the pressure at the inlet of primary heat exchanger 20, and are connected to collector box 26 through a pressure tube 48 to sense a pressure at the outlet of secondary heat exchanger 24.

When thermostat 34 provides a call-for-heat signal to furnace control 54 and furnace control 54 determines that furnace 10 is to operate at its low firing rate, furnace control 54 accelerates inducer motor 32 until it attains a pre-ignition steady state speed corresponding to a heat exchanger differential pressure that is sufficient to actuate low pressure switch 42, but not high pressure switch 44. When this differential pressure has been sustained for a preset time, gas valve 18 assumes its low open state. Under this condition, gas valve 18 supplies gas at the low firing rate to burner assembly 12, which ignites the gas and begins heating the combustion gases passing through the heat exchange assembly. This heating initiates a change in the density of the combustion air which, in turn, causes an increase in the differential pressure across the heat exchange assembly. The speed of inducer motor 32 is then reduced until it attains a steady state speed value that corresponds to a heat exchanger differential pressure that is somewhat lower than its pre-ignition value. After reducing the speed of inducer motor 32, furnace control 54 provides a signal that causes blower motor 52 to accelerate until it reaches a steady state speed that corresponds to a circulating airflow at which furnace 10 is designed to operate at low stage.

Similarly, when thermostat 34 provides a call-for-heat signal to furnace control 54 and furnace control 54 determines that furnace 10 is to operate at its high firing rate, furnace control 54 accelerates inducer motor 32 until it attains a pre-ignition steady state speed that corresponds to a heat exchanger differential pressure that is sufficient to actuate both low pressure switch 42 and high pressure switch 44. When this differential pressure has been sustained for a preset time, gas valve 18 assumes its high open state. Under this condition, gas valve 18 supplies gas at the high firing rate to burner assembly 12, which ignites the gas and begins heating the combustion gases passing through the heat exchanger assembly. This heating initiates a change in the density of the combustion gases which, in turn, causes an increase in the differential pressure across the heat exchange assembly. The speed of inducer motor 32 is then increased to attain a steady state speed value that corresponds to a heat exchanger differential pressure that is somewhat higher than its pre-ignition value. After increasing the speed of inducer motor 32, furnace control 54 causes blower motor 52 to accelerate to a steady state speed value that corresponds to the circulating airflow value at which furnace 10 is designed to operate.

In order to reduce the operating cost of furnace 10 by improving its annual fuel utilization efficiency (AFUE), the combustion airflow for furnace 10 may be adapted to provide for intermediate stages of operation between the low and high stages of operation. This may be accomplished by providing an additional pressure switch that actuates at a heat exchanger pressure level intermediate that of low pressure switch 42 and high pressure switch 44. While the pressure switch assembly including low pressure switch 42 and high pressure switch 44 may be exchanged for a pressure switch assembly including low, medium, and high pressure switches, the circuitry in furnace control 54 only provides two inputs on which the pressure switches provide pressure signals related to the pressure in the heat exchanger assembly.

Figure 2:
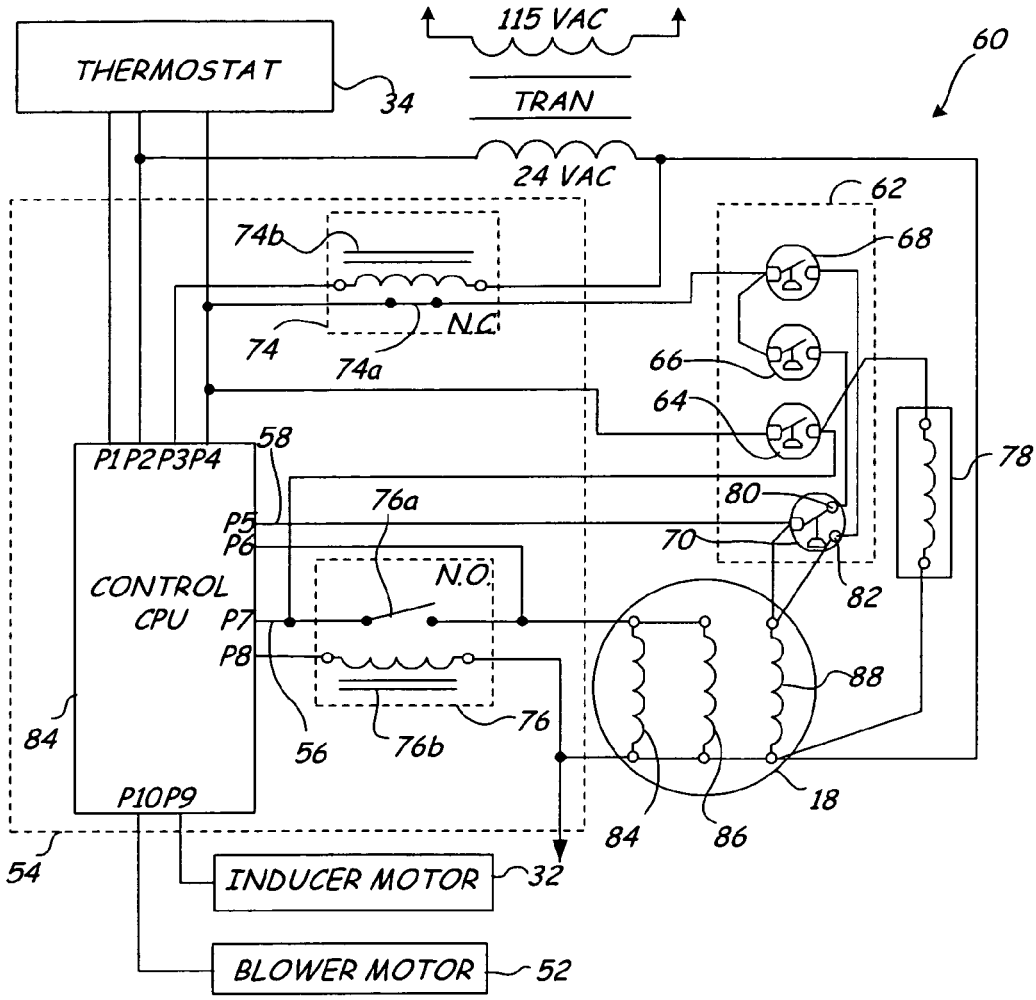
FIG. 2 is a schematic diagram of a gas flow portion of a furnace including a four pressure switch assembly for three-stage operation.

FIG. 2 is a schematic view of gas flow portion 60 of a furnace that is configured for three-stage operation. Similar components between gas flow portion 60 and the gas flow portion of furnace 10 (FIG. 1) are labeled with like numbers, including gas valve 18, inducer motor 32, thermostat 34, blower motor 52, and furnace control 54. Gas flow portion 60 also includes pressure switch assembly 62 (including low pressure switch 64, medium pressure switch 66, high pressure switch 68, and medium-high pressure switch 70), throttling valve relay 74 (including switch 74*a* and solenoid 74*b*), gas valve relay 76 (including switch 76*a* and solenoid 76*b*), and throttling valve 78.

The operation of gas control portion 60 is monitored and controlled by furnace control 54, which includes control CPU 84 including connection pins, labeled P1, P2, P3, P4, P5, P6, P7, P8, P9, and P10, to provide signals to and receive signals from the components of gas flow portion 60. Thermostat 34 is connected to pin P1 to communicate with control CPU 84, and power is supplied from a 24-VAC transformer secondary to thermostat 34 and to pin P2 of control CPU 84. Relay solenoids 74*b* and 76*b* are connected to pins P3 and P8, respectively, to receive energizing signals from control CPU 84. The poles of low pressure switch 64 and the pole of relay switch 74*a* are connected to pin P4. The output contact of low pressure switch 64 is connected to first pressure switch input on pin P7 of control CPU 84 to provide pressure signals to control CPU 84. The pole of relay switch 76*a* is also connected to pin P7, and the output contact of relay switch 76*a* is connected to pin P6 and to main and redundant solenoids 84 and 86 of gas valve 18. The poles of medium and high pressure switches 66 and 68 are connected to the output contact of relay switch 74*a*. The output contact of medium pressure switch 66 is connected to the normally closed output contact 80 of medium-high pressure switch 70 and to throttling valve 78. The output contact of high pressure switch 68 is connected to the normally open output contact 82 of medium-high pressure switch 70 and to high-fire solenoid 88 of gas valve 18. The pole of medium-high pressure switch 70 is connected to second pressure switch input 58 on pin P5 of control CPU 84. Control CPU 84 provides control signals to inducer motor 32 and blower motor 52 via pins P9 and P10, respectively. It should be noted that the schematic in FIG. 2 only shows the connectivity of components of gas flow portion 60 in the furnace, and components from other portions of a heating, ventilation, and air conditioning (HVAC) system may also be connected to and controlled by furnace control 54. However, these components are omitted from FIG. 2 for clarity.

Figure 3:
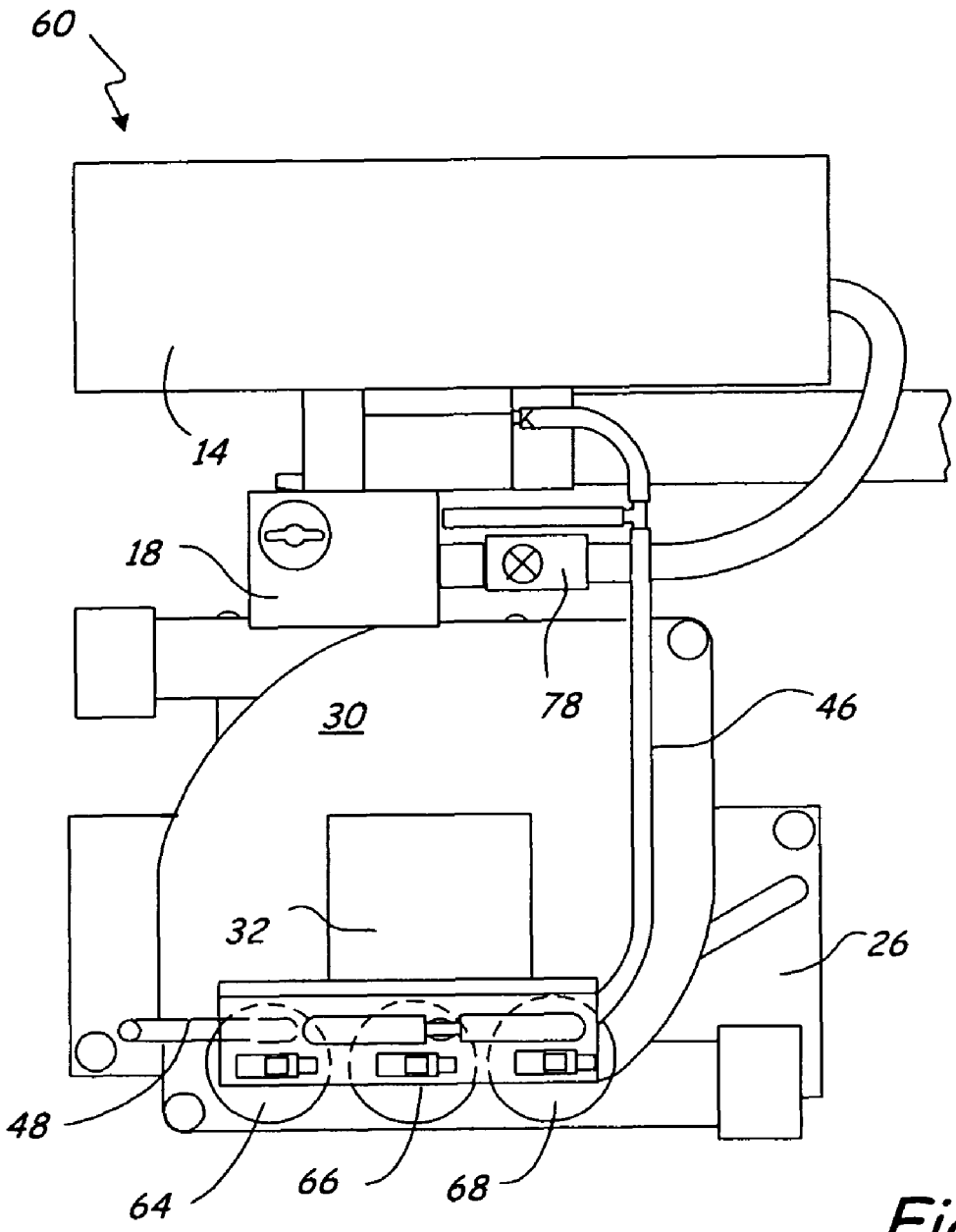
FIG. 3 is a plan view of the gas flow control portion of a three-stage furnace.

FIG. 3 is a plan view of gas flow control portion 60 of a furnace including low pressure switch 64, medium pressure switch 66, and high pressure switch 68. Pressure switches 64, 66, and 68 are connected to sense the differential pressure across the heat exchanger assembly, and are used by furnace control 54 circuit in conjunction with respective low, medium and high stage operation in the furnace. Medium-high pressure switch 70, which is not shown in FIG. 3, may be similarly disposed to sense the differential pressure across the heat exchanger assembly, or may be disposed elsewhere along pressure tubes 46 and 48 to sense the heat exchanger differential pressure. Control CPU 84 is configured with updated software or firmware for proper processing of the pressure signals received on the two pressure switch inputs 56 and 58 from pressure switch assembly 62 and thus enabling three stages of operation.

Throttling valve 78 may comprise a multi-stage throttling valve having at least a first, high open state that provides a low resistance to the flow of gas, and a second, low open state that provides a relatively high resistance to the flow of gas. Throttling valve 78 is disposed in fluidic series between burner box 14 and gas valve 18 (FIGS. 1 and 3). When the solenoid of throttling valve 78 is de-energized, it is in its low open state, and when the solenoid of throttling valve 78 is energized, it is in its high open state. The open state of throttling valve 78 is a function of the state of throttling valve relay 74, which is controlled by control CPU 84 using a time based staging algorithm that determines staging based on the duration call-for-heat signals provided by thermostat 34. As will be described in more detail below, control CPU 84 controls the open states of gas valve 18 and throttling valve 78 to provide three firing rates corresponding to three stages of operation.

When thermostat 34 provides a call-for-heat signal to furnace control 54 and control CPU 84 determines that the furnace should operate at its low or medium stage of operation, control CPU 84 keeps relay solenoid 74*b* de-energized, which maintains switch 74*a* in its normally closed state and supplies power to the medium and high heat pressure switches. Then control CPU 84 accelerates inducer motor 32 until it attains a pre-ignition steady state speed corresponding to a heat exchanger differential pressure that is sufficient to actuate low heat pressure switch 64 and medium heat pressure switch 66, but not medium-high pressure switch 70 or high heat pressure switch 68. This provides power at the pole of relay switch 76*a*.

When the medium combustion pressure has been sustained for a preset time, gas valve 18 and throttling valve 78 assume states that correspond to the medium firing rate for ignition. The medium firing rate is used for ignition of both the low and medium firing rates because ignition at the low firing rate may not be possible for ignition (but is sufficient to support combustion after ignition). To provide the medium firing rate, control CPU 84 energizes solenoid coil 76*b* to close relay switch 76*a*. When relay switch 76*a* is closed, power is provided to main and redundant solenoids 84 and 86, which causes gas valve 18 and throttling valve 78 to assume its low open state. In addition, control CPU 84 keeps relay solenoid 74*b* de-energized, which maintains switch 74*a* in its normally closed state and energizes the solenoid of throttling valve 78. The combination of gas valve 18 in its low open state and throttling valve 78 in its high open state provides the medium firing rate. In one embodiment, gas is supplied at medium firing rate at 65% of the high firing rate.

Gas valve 18 and throttling valve 78 supply gas at the medium firing rate to burner assembly 12, which ignites the gas and begins heating the combustion gases passing through the heat exchange assembly. This heating initiates a change in the density of the combustion gases that, in turn, causes an increase in the differential pressure across the heat exchanger assembly. At this time, for a medium call for heat, control CPU 84 maintains gas valve 18 and throttling valve 78 to continue to provide gas at the medium firing rate. For a low call for heat, control CPU 84 energizes relay solenoid 74*b* to open relay switch 74*a* and de-energize the solenoid of throttling valve 68. The causes throttling valve 78 to assume its low open state which, in combination with the low open state of gas valve 18, provides the low firing rate. In one embodiment, gas is supplied at the low firing rate at 40% of the high firing rate.

For both medium and low firing rates, the speed of inducer motor 32 is then reduced until it attains a steady state speed value that corresponds to a heat exchanger differential pressure that is somewhat lower than its pre-ignition value. For the medium firing rate, this heat exchanger differential pressure is maintained until operation of the furnace is terminated or until control CPU 84 determines that it needs to operate at another stage. For the low firing rate, the speed of inducer motor 32 is again reduced to its low stage steady state speed to provide a heat exchanger differential pressure corresponding to low stage operation of the furnace. The heat exchanger differential pressure for low stage operation is still sufficient to maintain the closed state of pressure switch 64.

Control CPU 84 then provides a signal that causes blower motor 52 to accelerate until it reaches a steady state speed to provide a circulating airflow corresponding to the stage of operation.

When thermostat 34 provides a call-for-heat signal to control CPU 84 and control CPU 84 determines that the furnace is to operate at its high stage of operation, control CPU 84 provides power to pressure switch 64 and relay switch 74*a*. Control CPU 84 then accelerates inducer motor 32 until it attains a pre-ignition steady state speed corresponding to a heat exchanger differential pressure that is sufficient to actuate low pressure switch 64, medium pressure switch 66, medium-high pressure switch 70, and high pressure switch 68. When the medium-heat pressure switch is actuated it switches to its normally open position (i.e., at contact 82). This provides power at first pressure switch input 56 and at the pole of relay switch 76*a* via low pressure switch 64, and provides power at second pressure switch input 58 via high pressure switch 68 and medium-high pressure switch 70, and energizes high-fire solenoid 88 of gas valve 18.

When the high combustion pressure has been sustained for a preset time, control CPU 84 energizes solenoid coil 76*b* to close relay switch 76*a*. When relay switch 76*a* is closed, power is provided to main and redundant solenoids 84 and 86, which, in combination with the energized state of high-fire solenoid 88, causes gas valve 18 to assume its high open state. In addition, control CPU 84 keeps relay solenoid 74*b* de-energized, which maintains switch 74*a* in its normally closed state and energizes the solenoid of throttling valve 78, putting throttling valve 78 in its high open state. The combination of gas valve 18 and throttling valve 78 in their high open state provides the high firing rate.

Gas valve 18 and throttling valve 78 supply gas at the high firing rate to burner assembly 12, which ignites the gas and begins heating the combustion air passing through the heat exchange assembly. The speed of inducer motor 32 is then increased until it attains a steady state speed value that corresponds to a heat exchanger differential pressure that is somewhat higher than its pre-ignition value. Control CPU 84 then provides a signal that causes blower motor 52 to accelerate until it reaches a steady state speed to provide a circulating airflow corresponding to the high stage of operation.

Figure 4:
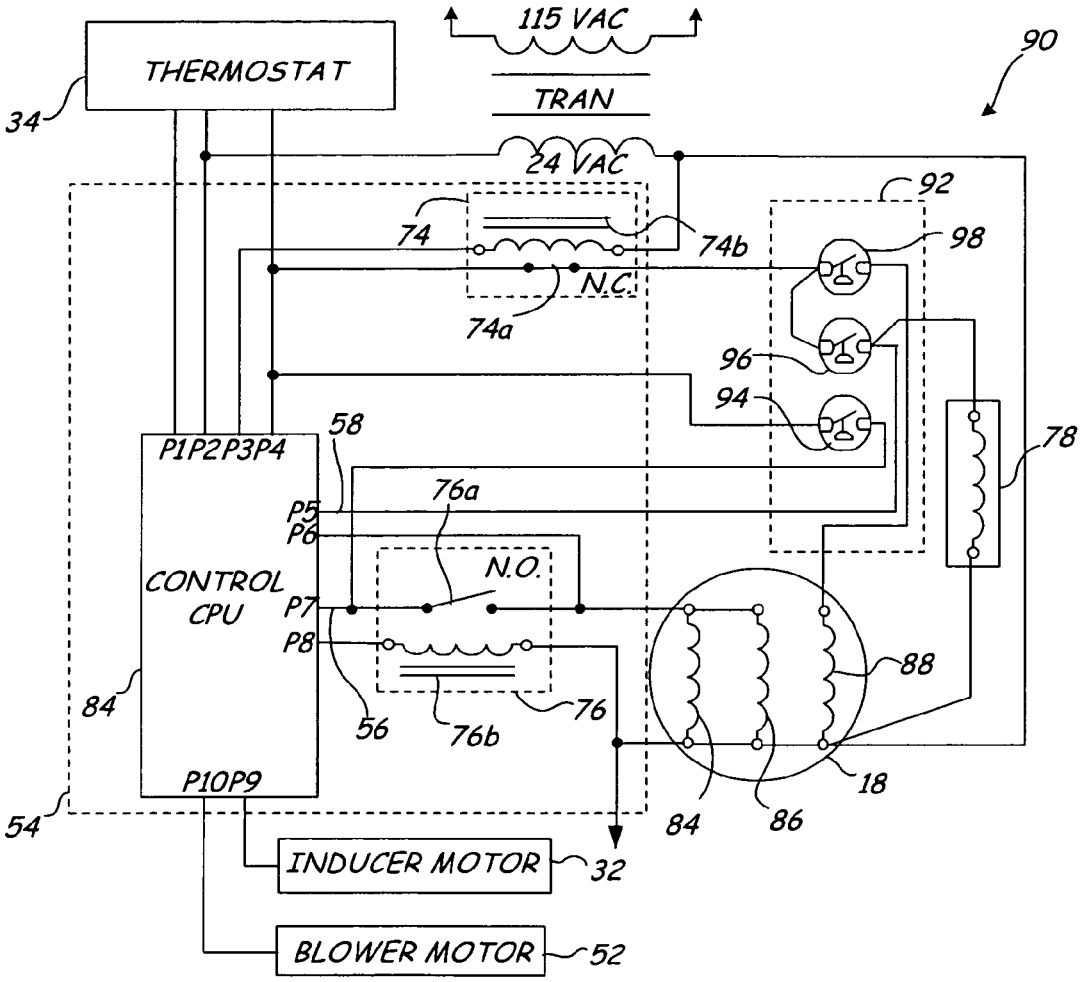
FIG. 4 is a schematic diagram of a gas flow portion of a furnace including a three pressure switch assembly for three-stage operation.

While pressure switch assembly 62 includes four pressure switches, variations on this design can be made to include other numbers of pressure switches for three-stage operation of a furnace. For example, FIG. 4 is a simplified schematic diagram of gas flow portion 90 of a furnace including pressure switch assembly 92 for three-stage operation. Similar to pressure switch assembly 62, pressure switch assembly 92 is also operable to provide pressure information related to low, intermediate, and high combustion pressures via two pressure switch inputs 56 and 58 on control CPU 84. Pressure switch assembly 92 includes low pressure switch 94, medium pressure switch 96, and high pressure switch 98. Low pressure switch 94 is a single pole, single throw switch configured to actuate at the low combustion pressure, medium pressure switch 96 is a single pole, single throw switch configured to actuate at the intermediate combustion pressure, and high pressure switch 98 is a single pole, single throw switch configured to actuate at the high combustion pressure.

Similar to gas flow control portion 60 shown in FIGS. 2 and 3, pressure switches 94, 96, and 98 are connected to sense the differential pressure across the heat exchanger assembly, and are used by furnace control 54 circuitry in conjunction with respective low, medium and high demand to initiate low, medium and high stage operation in the furnace. When pressure switch assembly 92 has been installed across the heat exchange assembly, Control CPU 84 is configured with updated software or firmware for proper processing of the pressure signals received on the two pressure switch inputs 56 and 58.

When thermostat 34 provides a call-for-heat signal to furnace control 54 and control CPU 84 determines that the furnace should operate at its low or medium firing rate, the gas flow control portion of a furnace including pressure switch assembly 92 operates substantially similarly to gas flow control portion 60 at its low or medium firing rate as described with regard to FIGS. 2 and 3. Also similar to the embodiment in FIGS. 2 and 3, in response to call-for-heat signals from thermostat 34 and control CPU 84 has determined that the furnace should operate at medium or high firing rate, control CPU 84 accelerates inducer motor 32 until it attains a pre-ignition steady state speed that corresponds to a heat exchanger differential pressure that is sufficient to actuate medium pressure switch 96 (for medium firing rate) or medium pressure switch 96 and high pressure switch 98 (for high firing rate).

In this embodiment, medium pressure switch 96 is connected to second pressure switch input 58, while high pressure switch 98 is not connected to either of pressure switch inputs 56 or 58. Thus, high pressure switch 98 is not directly monitored by control CPU 84. When medium pressure switch 96 actuates in response to intermediate or high pressure levels corresponding to medium or high firing rates, control CPU 84 energizes solenoid coil 76*b* to close relay switch 76*a* to provide power to main and redundant solenoids 84 and 86 of gas valve 18. For medium stage operation, control CPU 84 keeps relay solenoid 74*b* de-energized, which maintains switch 74*a* in its normally closed state and energizes the solenoid of throttling valve 78, putting throttling valve 78 in its high open state. The combination of gas valve 18 in its low open state and throttling valve 78 in its high open state provides the medium firing rate. For high stage operation, high pressure switch 98 is actuated by high combustion pressure, which energizes high-fire solenoid 88. Control CPU 84 keeps relay solenoid 74*b* de-energized, which maintains switch 74*a* in its normally closed state and energizes the solenoid of throttling valve 78, putting throttling valve 78 in its high open state. The combination of gas valve 18 and throttling valve 78 in their high open states provides the high firing rate.

With medium pressure switch 96 closed, control CPU 84 samples the speed of inducer motor 32 to determine how next to control inducer motor 32 to adjust the heat exchanger differential pressure. More particularly, for medium stage operation, control CPU 84 samples the speed of inducer motor 32 and reduces the speed of inducer motor 32 until it establishes the steady state combustion airflow that is associated with medium stage operation. For high stage operation, control CPU 84 samples the speed of inducer motor 32 and increases the speed of inducer motor 32 to attain a steady state speed value that is somewhat higher than its pre-ignition value. After adjusting the speed of inducer motor 32, control CPU 84 causes the blower motor 52 to accelerate to a steady state speed value that corresponds to the circulating airflow value corresponding to the stage of operation.

In summary, the subject invention is directed to a pressure switch assembly for use with a furnace controller having a first input and a second input. A first pressure switch is configured to actuate at a first combustion pressure level and is connected to the first input. A second pressure switch is configured to actuate at a second combustion pressure level, and a third pressure switch is configured to actuate at a third combustion pressure level. Pressure signals provided on the second input from at least one of the second pressure switch and the third pressure switch are used by the furnace controller to derive actuation states of the second and third pressure switches. By allowing the gas control portion of a two-stage furnace to be adapted to provide for intermediate stages of operation, the operating cost of the furnace is reduced without requiring replacement of the furnace control circuit board or the entire furnace unit.

Although the present invention has been described with reference to examples and preferred embodiments, workers skilled in the art will recognize that changes may be made in form and detail without departing from the spirit and scope of the invention.

The invention claimed is:

1. A gas-fired induced-draft furnace that has low, medium, and high firing rates, the furnace comprising:

a furnace controller having a first pressure switch input and a second pressure switch input;

a heat exchanger;

a pressure switch assembly configured to sense low, medium, and high pressures across the heat exchanger corresponding to the low, medium, and high firing rates and to generate pressure signals that vary in accordance with the differential pressure sensed across the heat exchanger, wherein the pressure signals are provided on the first and second pressure switch inputs;

wherein the pressure switch assembly comprises:

a low-heat pressure switch configured to actuate at a low combustion pressure level and connected to the first pressure switch input;

a medium-heat pressure switch configured to actuate at an intermediate combustion pressure level;

a high-heat pressure switch configured to actuate at a high combustion pressure level; and a medium-high-heat switch arranged to connect the medium-heat pressure switch to the second pressure switch input at the intermediate combustion pressure level and to connect the high-heat pressure switch to the second pressure switch input at the high combustion pressure level.

2. The furnace of claim 1, wherein the medium-high heat pressure switch is a single pole, double throw switch and the pole is connected to the second pressure switch input.

3. The furnace of claim 1, wherein the medium-high heat pressure switch is configured to actuate between the intermediate combustion pressure level and the high combustion pressure level.

4. The furnace of claim 1, wherein the low-heat, medium-heat, and high-heat pressure switches are single pole, single throw switches.

5. The furnace of claim 1, wherein the medium-high heat pressure switch provides a first signal to the furnace controller at the intermediate combustion pressure level indicating that the medium-heat pressure switch is connected to the second pressure switch input, and provides a second signal to the furnace controller at the high combustion pressure level indicating that the high-heat pressure switch is connected to the second pressure switch input.

6. A gas-fired induced-draft furnace that has low, medium, and high firing rates, the furnace comprising:

a furnace controller having a first pressure switch input and a second pressure switch input;

a pressure switch assembly configured to sense low, medium, and high pressures across the heat exchanger corresponding to the low, medium, and high firing rates and to generate pressure signals that vary in accordance with the differential pressure sensed across the heat exchanger, wherein the pressure signals are provided on the first and second pressure switch inputs;

wherein the pressure switch assembly comprises:

a low-heat pressure switch configured to actuate at a low combustion pressure level and connected to the first pressure switch input;

a medium-heat pressure switch configured to actuate at an intermediate combustion pressure level;

a high-heat pressure switch configured to actuate at a high combustion pressure level;

a first pole of the low-heat pressure switch being connected to a pin on the controller, a second pole of the low-heat pressure switch being connected to the first pressure switch input;

a first pole of the medium-heat pressure switch being connected to a first pole of the high-heat pressure switch, the first pole of the medium-heat pressure switch being connected to the pin on the controller;

a medium-high-heat switch arranged to connect the medium-heat pressure switch to the second pressure switch input at the intermediate combustion pressure level and to connect the high-heat pressure switch to the second pressure switch input at the high combustion pressure level;

a second pole of the medium-heat pressure switch being connected to a contact of the medium-high-heat switch, a second pole of the high-heat pressure switch being connected to a contact of the medium-high-heat switch, the medium-high-heat switch coupling one of the medium-heat pressure switch and the high-heat pressure switch to the second pressure switch input.

* * * * *